US012529504B2

(12) United States Patent
Ryu et al.

(10) Patent No.: US 12,529,504 B2
(45) Date of Patent: Jan. 20, 2026

(54) ADJUSTABLE AIR FLOW SYSTEM FOR A REFRIGERATOR APPLIANCE

(71) Applicant: Haier US Appliance Solutions, Inc., Wilmington, DE (US)

(72) Inventors: Choonjae Ryu, Prospect, KY (US); Stephanos Kyriacou, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 248 days.

(21) Appl. No.: 18/526,664

(22) Filed: Dec. 1, 2023

(65) Prior Publication Data

US 2025/0180272 A1 Jun. 5, 2025

(51) Int. Cl.

| | |
|---|---|
| ***F25D 17/04*** | (2006.01) |
| ***F25D 11/02*** | (2006.01) |
| ***F25D 21/00*** | (2006.01) |
| ***F25D 29/00*** | (2006.01) |

(52) U.S. Cl.

CPC ..... *F25D 17/045* (2013.01); *F25D 11/02* (2013.01); *F25D 21/006* (2013.01); *F25D 29/00* (2013.01); *F25D 2600/04* (2013.01)

(58) Field of Classification Search

CPC ..... F25D 17/045; F25D 11/02; F25D 21/006; F25D 29/00; F25D 2600/04

See application file for complete search history.

(56) References Cited

U.S. PATENT DOCUMENTS

| | | | |
|---|---|---|---|
| 8,950,209 B2 | 2/2015 | Junge et al. | |
| 11,226,145 B2 | 1/2022 | Seong et al. | |
| 2018/0224185 A1* | 8/2018 | Besore | F25D 17/045 |

FOREIGN PATENT DOCUMENTS

| | | | |
|---|---|---|---|
| KR | 20170029346 | A | 3/2017 |
| WO | WO2011001479 | A1 | 1/2011 |
| WO | WO2018103651 | A1 | 6/2018 |

* cited by examiner

*Primary Examiner* — Cassey D Bauer

(74) *Attorney, Agent, or Firm* — Dority & Manning, P.A.

(57) ABSTRACT

A refrigerator appliance includes a controller disposed in a cabinet, and the controller is in operable communication with a freezer damper assembly. The controller is configured to operate the compressor in order to simultaneously cool down both of the refrigerating compartment and the freezer compartment, as well as calculate a new open area of the freezer damper assembly based on a target temperature state. The target temperature state includes a refrigerator target temperature of the refrigerating compartment and a freezer target temperature of the freezer compartment. The controller is further configured to adjust a position of the freezer damper assembly to provide the calculated new open area.

20 Claims, 7 Drawing Sheets

ADJUSTABLE AIR FLOW SYSTEM FOR A REFRIGERATOR APPLIANCE

FIELD OF THE INVENTION

The present subject matter relates generally to refrigerator appliances, and more particularly to air flow systems for refrigerator appliances.

BACKGROUND OF THE INVENTION

Refrigerator appliances generally include a cabinet that defines a food storage chamber. These refrigerator appliances typically include air circulation systems to circulate cold or cool air throughout the food storage chamber to maintain a desired temperature within the food storage chamber. For instance, a fan may circulate air over an evaporator before supplying the air to the chamber via an air inlet.

In particular, supplying air supplies to multiple independent chambers within refrigerator appliances is required in order to properly maintain required temperatures. In some instances, individual air ducts may be positioned to supply air specifically to respective areas. However, these placements can potentially require modified operation of the refrigeration loop (e.g., altering compressor speeds) to supply different areas of the refrigerator appliance with different levels of cool air. As such, for single evaporator refrigerators having two temperature compartments, low evaporator temperature cooling typically causes undesired system efficiency.

Accordingly, a refrigerator appliance having a selective air supply system that increases system efficiency would be useful. In particular, an air supply assembly allowing air to be selectively supplied to individual compartments would be particularly beneficial.

BRIEF DESCRIPTION OF THE INVENTION

Aspects and advantages of the invention will be set forth in part in the following description, or may be obvious from the description, or may be learned through practice of the invention.

In one example aspect of the present disclosure a refrigerator appliance includes a cabinet defining a refrigerating compartment and a freezer compartment. A sealed cooling system of the refrigerator appliance includes a compressor and an evaporator. The refrigerator appliance also includes an air circulation duct system in fluid communication with the refrigerating compartment and the freezer compartment. The air circulation duct system includes a refrigerator duct and a freezer duct. A refrigerator damper assembly is disposed in the refrigerator duct. The refrigerator damper assembly is positioned and configured to selectively allow air to pass through the refrigerator duct and into the refrigerating compartment. The air circulation duct system also includes a freezer damper assembly disposed in the freezer duct. The freezer damper assembly is positioned and configured to selectively allow air to pass through the freezer duct and into the freezer compartment. The refrigerator appliance also includes a controller disposed in the cabinet. The controller is in operable communication with the freezer damper assembly. The controller is configured to operate the compressor in order to simultaneously cool down both of the refrigerating compartment and the freezer compartment, as well as calculate a new open area of the freezer damper assembly based on a target temperature state. The target temperature state includes a refrigerator target temperature of the refrigerating compartment and a freezer target temperature of the freezer compartment. The controller is further configured to adjust a position of the freezer damper assembly to provide the calculated new open area.

In another example aspect of the present disclosure is a method of operating a refrigerator appliance. The refrigerator appliance includes a cabinet defining a refrigerating compartment and a freezer compartment, and a sealed cooling system which includes a compressor and an evaporator. The refrigerator appliance also includes an air circulation duct system in fluid communication with the refrigerating compartment and the freezer compartment. The air circulation duct system includes a refrigerator duct and a freezer duct. A refrigerator damper assembly is disposed in the refrigerator duct. The refrigerator damper assembly is positioned and configured to selectively allow air to pass through the refrigerator duct and into the refrigerating compartment. The air circulation duct system also includes a freezer damper assembly disposed in the freezer duct. The freezer damper assembly is positioned and configured to selectively allow air to pass through the freezer duct and into the freezer compartment. The refrigerator appliance also includes a controller disposed in the cabinet, and the controller in operable communication with the freezer damper assembly. The method includes operating the compressor by the controller in order to simultaneously cool down both of the refrigerating compartment and the freezer compartment, and calculating, by the controller, a new open area of the freezer damper assembly based on a target temperature state. The target temperature state includes a refrigerator target temperature of the refrigerating compartment and a freezer target temperature of the freezer compartment. The method further includes adjusting a position of the freezer damper assembly by the controller to provide the calculated new open area.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
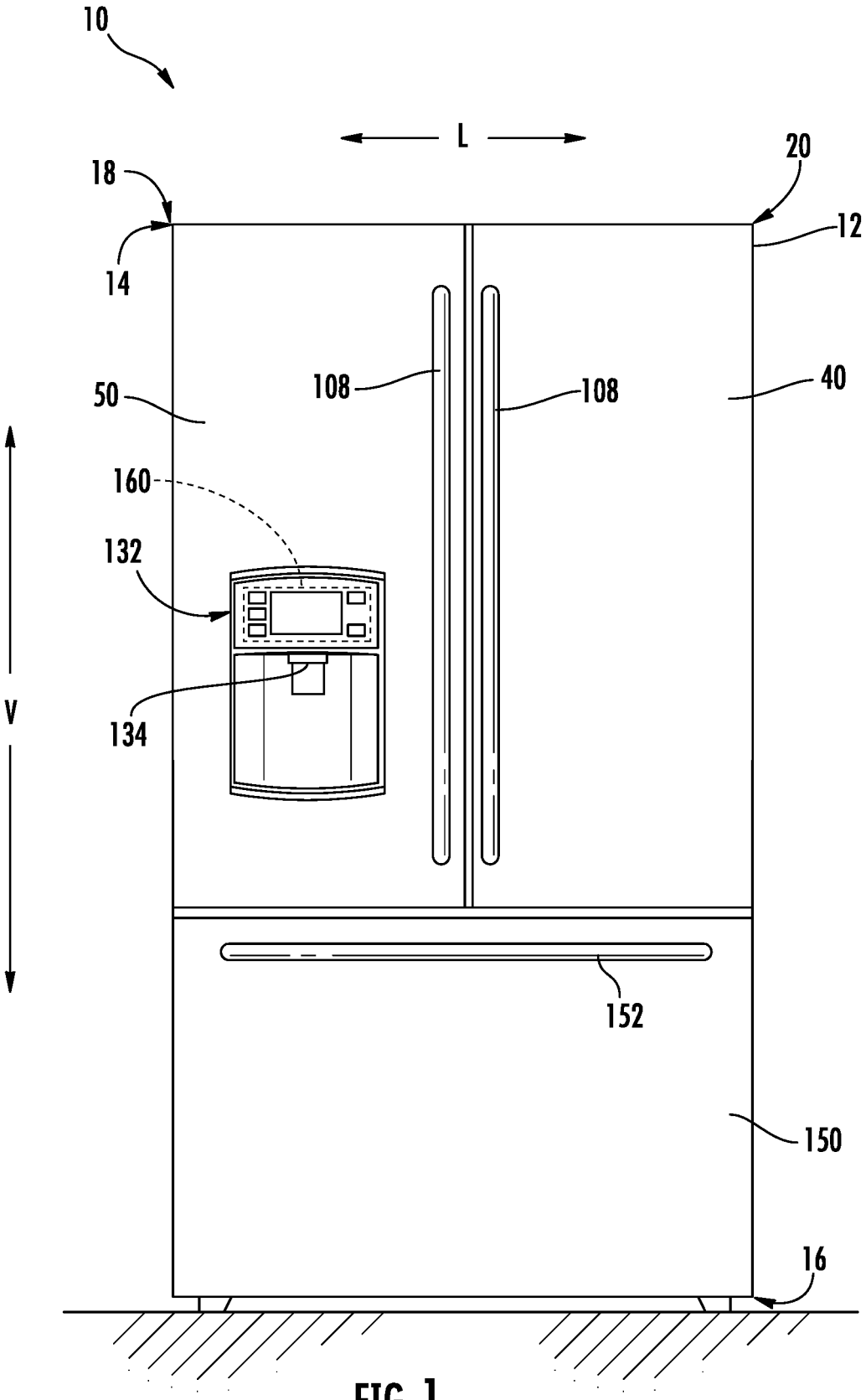
FIG. 1 provides a front elevation view of a refrigerator appliance according to example embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
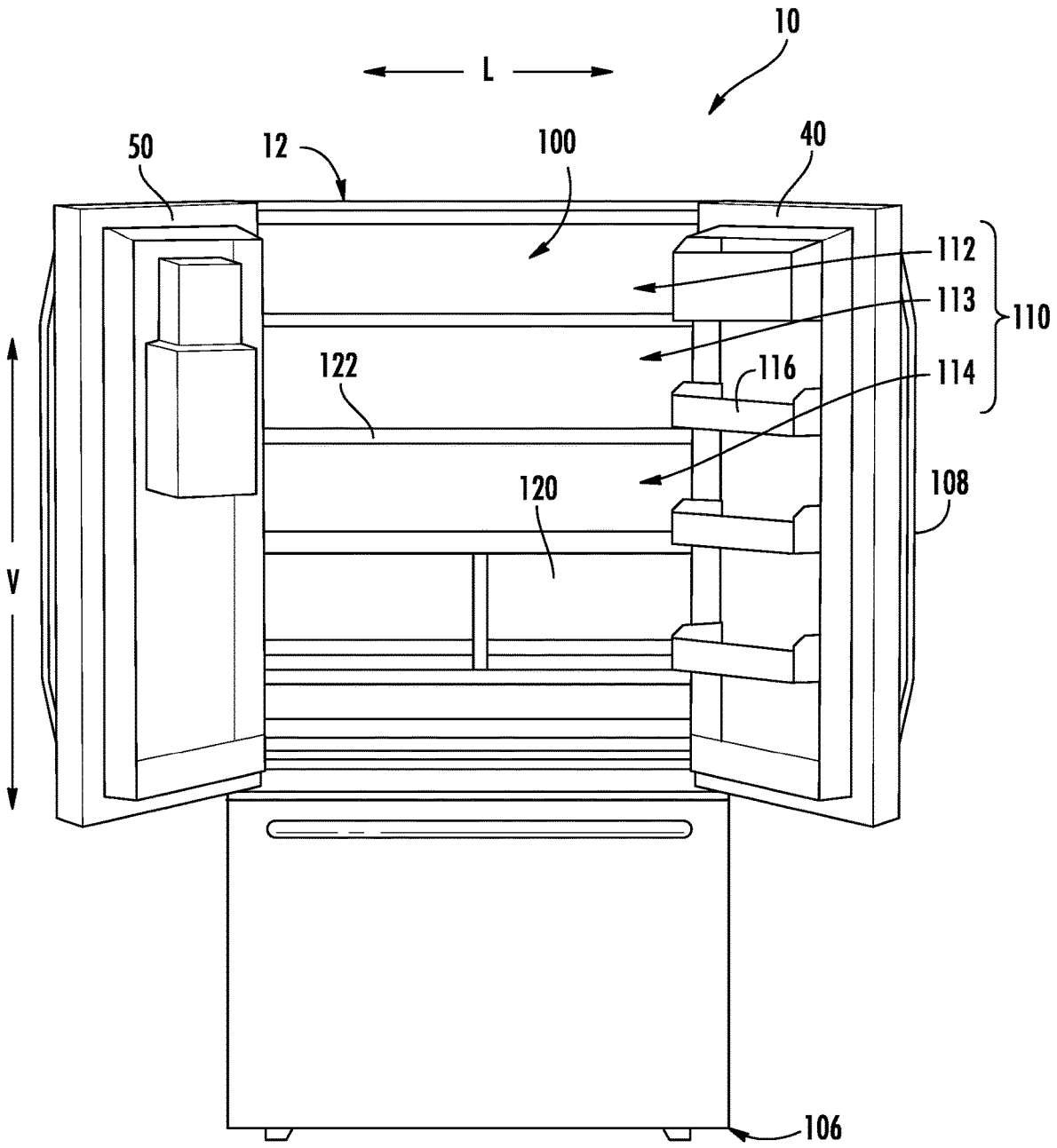
FIG. 2 provides a perspective view of the example refrigerator appliance of FIG. 1, with the doors in an open position.

Referring now to FIGS. 1 and 2, a refrigerator appliance 10 according to an embodiment of the present subject matter defines a vertical direction V, a lateral direction L, and a transverse direction T, each mutually perpendicular to one another. As may be seen, the refrigerator appliance 10 includes a housing or cabinet 12 that extends between a top 14 and a bottom 16 along the vertical direction V, between a left side 18 and a right side 20 along the lateral direction L, and between a front side 15 (FIG. 3) and a rear side 17 (FIG. 3) along the transverse direction T.

Cabinet 12 generally defines a refrigerating compartment 100 (FIG. 2) for receipt of items for storage in cool environments. In particular, refrigerating compartment 100 may be positioned at or adjacent the top 14 of the cabinet 12. It should be appreciated, however, that the refrigerating compartment 100 may be positioned at any suitable location within refrigerator appliance 10. For example, in one embodiment, the refrigerating compartment 100 may extend from top 14 to bottom 16 along the vertical direction V.

The refrigerator appliance 10 may include one or more refrigerator doors 40, 50 rotatably mounted to the cabinet, e.g., such that the refrigerator doors 40, 50 permit selective access to the refrigerating compartment 100. As shown, in some embodiments, the refrigerator doors 40, 50 include a right refrigerator door 40 and a left refrigerator door 50. The right refrigerator door 40 may be rotatably mounted to cabinet 12 at the right side 20 of cabinet 12. The left refrigerator door 50 may be rotatably mounted to the left side 18 of the cabinet 12. A handle 108 may be positioned on each of the refrigerator doors 40, 50 to facilitate movement of the doors 40, 50 between a fully closed position (FIG. 1) and a fully open position (FIG. 2).

Figure 3:
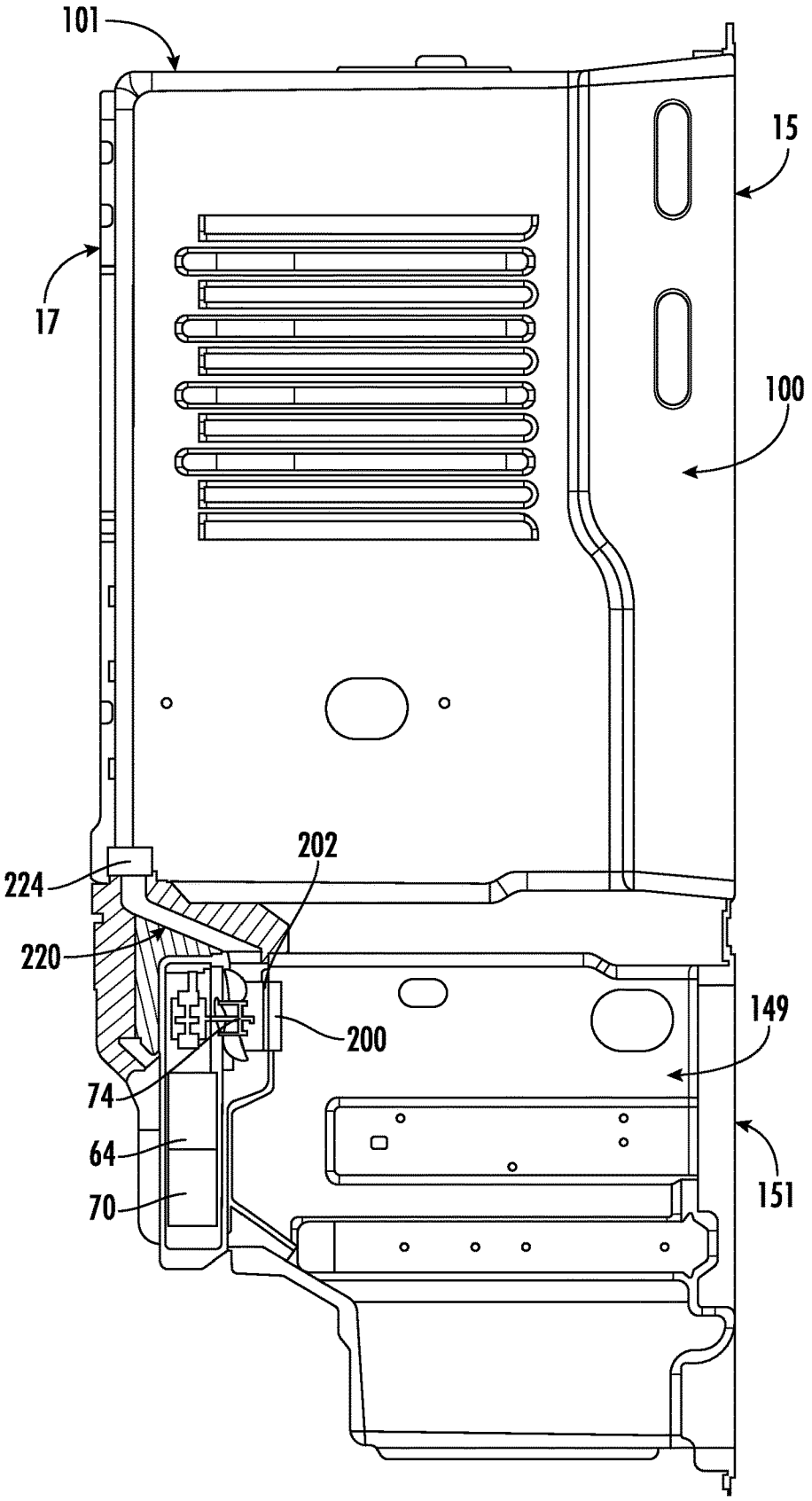
FIG. 3 provides a schematic view of an air supply system of the refrigerator appliance of FIG. 1 according to example embodiments of the present disclosure.

The refrigerator appliance 10 may also include a dispenser assembly 132 for dispensing liquid water and/or ice. The dispenser assembly 132 may include a dispenser 134 positioned on or mounted to an exterior portion of the refrigerator appliance 10, e.g., on the left refrigerator door 50. In addition, refrigerator appliance 10 may include freezer drawer 150 arranged below the refrigerator doors 40, 50 for selectively accessing items within a freezer compartment 149 (FIG. 3). The freezer drawer 150 may include a handle 152 that is slidably mounted to cabinet 12. Accordingly, freezer drawer 150 may be moved in and out of freezer compartment 149 along the transverse direction T.

As shown in FIG. 2, various storage components may be mounted within refrigerating compartment 100 to generally facilitate storage of food items. In certain embodiments, the storage components include bins 116, drawers 120, and shelves 122 that are mounted within the refrigerating compartment 100. The bins 116, drawers 120, and shelves 122 are configured for receipt of items (e.g., beverages and/or solid food items, medications, etc.) and may assist with organizing such food items.

FIG. 3 provides a schematic view of an air circulation duct system along with an inner liner according to example embodiments of the present disclosure. In general, a liner 101 and an inner liner 151 may define refrigerating compartment 100 and freezer compartment 149, respectively. In particular, inner liner 151 may define freezer compartment 149, e.g., freezer drawer 150 may be received within freezer compartment 149 of inner liner 151. The air circulation duct system within refrigerator appliance 10 may generally be in fluid communication, e.g., fluidly coupled, with refrigerating compartment 100 and freezer compartment 149. In particular, the air circulation duct system may include a refrigerator duct and a freezer duct, such as refrigerator duct 220 and a freezer duct 202. In general, the refrigerator duct 220 may extend from the freezer duct 202 to a refrigerator damper assembly 224. In particular, refrigerator damper assembly 224 may selectively allow air to pass through refrigerator duct 220 and into refrigerating compartment 100. Further, freezer duct 202 may include a freezer damper assembly 200 generally configured to selectively allow air to pass through freezer duct 202 and into freezer compartment 149. Freezer damper assembly 200 and operation thereof will be described in further detail hereinbelow.

Figure 4:
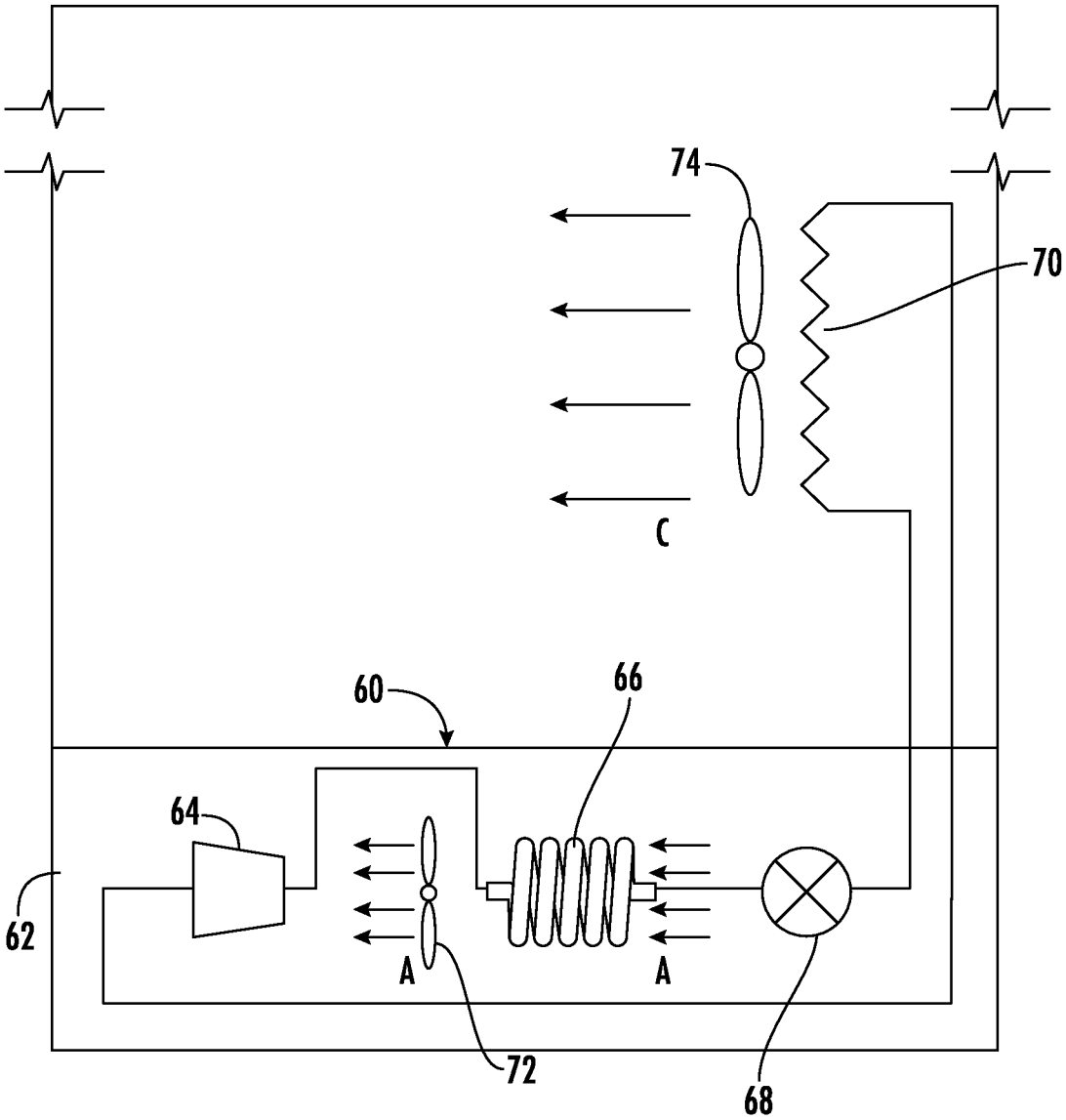
FIG. 4 provides a schematic illustration of an example sealed cooling system as may be used with a refrigerator appliance in one or more example embodiments of the present subject matter.

FIG. 4 provides a schematic view of the refrigerator appliance 10, in particular the sealed cooling system 60 thereof. The sealed cooling system 60 is the only cooling system present in refrigerator appliance 10, and as such the evaporator, described hereinbelow, is the only evaporator in refrigerator appliance 10. As illustrated in FIG. 4, refrigerator appliance 100 includes a mechanical compartment 62 that at least partially contains components for executing a known vapor compression cycle for cooling air. The components include a compressor 64, a heat exchanger or condenser 66, an expansion device 68, and an evaporator 70 connected in series and charged with a refrigerant. Evaporator 70 is also a type of heat exchanger which transfers heat from air passing over the evaporator to a refrigerant flowing through evaporator 70 thereby causing the refrigerant to vaporize. As such, cooled air C is produced and configured to refrigerate refrigerating compartment 100 and freezer compartment 149 of refrigerator appliance 10. For example, the cooled air C may be either independently or simultaneously directed to refrigerating compartment 100 and/or freezer compartment 149 by a fan 74. In particular, cooled air C may be directed through refrigerator damper assembly 224 (FIG. 3) into refrigerating compartment 100 and/or freezer damper assembly 200 (FIG. 3) into freezer compartment 149. In some example embodiments, fan 74 may be a freezer fan generally configured to direct air into the freezer compartment 149.

From evaporator 70, vaporized refrigerant flows to compressor 64, which operates to increase the pressure of the refrigerant. This compression of the refrigerant raises its temperature, which is lowered by passing the gaseous refrigerant through condenser 66 where heat exchange with ambient air takes place so as to cool the refrigerant. A fan 72 is used to pull air across condenser 66, as illustrated by arrows A, so as to provide forced convection for a more rapid and efficient heat exchange between the refrigerant and the ambient air.

Expansion device 68 further reduces the pressure of refrigerant leaving condenser 66 before being fed as a liquid to evaporator 70. Collectively, the vapor compression cycle components in a refrigeration circuit, associated fans, and associated compartments are sometimes referred to as a sealed refrigeration system operable to force cold air through refrigerating compartment 100 and freezer compartment 149. The cooling system 60 depicted in FIG. 4 is provided by way of example only. It is within the scope of the present invention for other configurations of the refrigeration system to be used as well. For example, fan 74 may be repositioned so as to push air across evaporator 70, one or more additional fans may be provided, and numerous other configurations may be applied as well.

Figure 7:
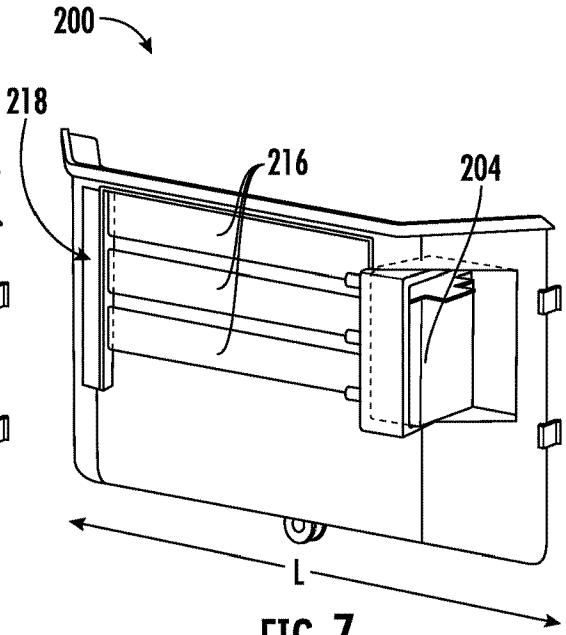
FIG. 7 provides a front perspective view of another alternative freezer damper assembly according to example embodiments of the present disclosure.
Figure 6:
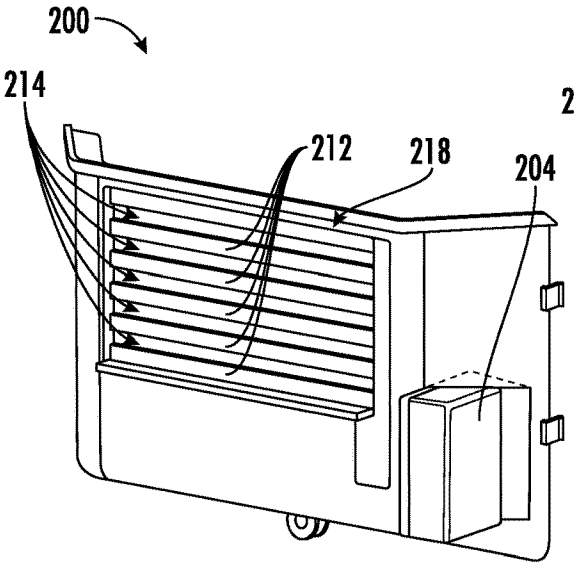
FIG. 6 provides a front perspective view of an alternative freezer damper assembly according to example embodiments of the present disclosure.
Figure 5:
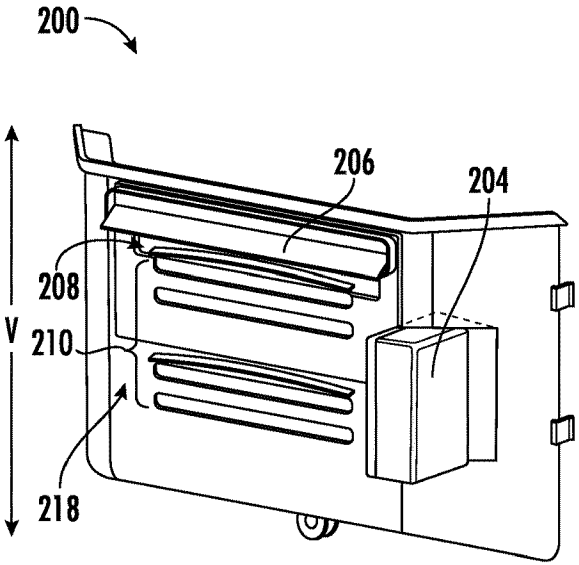
FIG. 5 provides a front perspective view of a freezer damper assembly according to example embodiments of the present disclosure.

In general FIGS. 5-7 provide a front perspective view of various examples of freezer damper assembly 200 according to example embodiments of the present disclosure. As may be seen in FIG. 5, freezer damper assembly 200 may include a motor 204 generally configured to slide or translate a door 206 in the vertical direction V. In general, a plurality of slots 210 may be defined by freezer damper assembly 200, and the plurality of slots 210 may define an air outlet 218. Further, the sliding door may define an opening 208, wherein, when door 206 is translated in the vertical direction V, opening 208 of door 206 may be configured to align with a respective slot 210 of the plurality of slots 210. In other words, door 206 may be configured to translate away from the plurality of slots 210 of freezer damper assembly 200, and the opening 208 may align with at least one of the plurality of slots 210. Additionally, or alternatively, door 206 may translated such that air outlet 218 is fully open, e.g., each slot 210 of the plurality of slots 210 may be unblocked by door 206. In other words, an open area of freezer damper assembly 200 may be fully open, e.g., one hundred percent (100%) open when door 206 is translated such that air outlet 218 is fully open. In the present example embodiment, door 206 may be configured to translate such that the open area of freezer damper assembly 200 may be any value between zero percent (0%) and one hundred percent (100%). In general, the open area of freezer damper assembly 200 may correlate to a percentage of air flowing through freezer damper assembly 200, and the respective difference in the percentage flowing through refrigerator damper assembly 224. For example, in a scenario where the open area is sixty percent (60%), sixty percent (60%) of air may be flowing through the freezer damper assembly 200 and forty percent (40%) of air may be flowing through the refrigerator damper assembly 224.

As may be seen in FIG. 6, another example embodiment of freezer damper assembly 200 may include motor 204 operatively coupled to a plurality of slats 212 configured to translate away from a plurality of slots 214, where each slat 212 of the plurality of slats 212 covers a respective slot 214 of the plurality of slots 214. In general, in this example embodiment, the plurality of slots 214 define air outlet 218 of freezer damper assembly 200. In general, the plurality of slats 212 may be configured to translate away from the plurality of slots 214 of freezer damper assembly 200, e.g., in the vertical direction V. Additionally, or alternatively, the plurality of slats 212 may translated such that air outlet 218 is fully open, e.g., each slot 214 of the plurality of slots 214 may be unblocked by the plurality of slats 212. In other words, the open area of freezer damper assembly 200 may be fully open, e.g., one hundred percent (100%) open when the plurality of slats 212 are translated such that air outlet 218 is fully open. Similar to door 206 of FIG. 5, in the present example embodiment of FIG. 6, the plurality of slats 212 may be configured to translate such that the open area of freezer damper assembly 200 may be any value between zero percent (0%) and one hundred percent (100%).

As may be seen in FIG. 7, another example embodiment of freezer damper assembly 200 may include motor 204 operably coupled to a plurality of slats 216 generally configured to rotate within air outlet 218 of freezer damper assembly 200. In general, the plurality of slats 216 may be configured to rotate within air outlet 218 of freezer damper assembly 200, e.g., about the lateral direction L. Additionally, or alternatively, the plurality of slats 212 may translated such that air outlet 218 is fully open, e.g., air outlet 218 may be unblocked by the plurality of slats 216. In other words, the open area of freezer damper assembly 200 may be fully open, e.g., one hundred percent (100%) open when the plurality of slats 216 are rotated such that air outlet 218 is fully open. In general, in the present example embodiment of FIG. 7, the plurality of slats 216 may be configured to rotate such that the open area of freezer damper assembly 200 may be any value between zero percent (0%) and one hundred percent (100%).

Referring again to FIG. 1, refrigerator appliance 10 may include or be in operative communication with a processing device or a controller 160 that may be generally configured to facilitate appliance operation. In this regard, controller 160 may receive control inputs from user input devices, may display information using any suitable display, and may otherwise regulate operation of refrigerator appliance 10. For example, signals generated by controller 160 may operate refrigerator appliance 10, including any or all system components, subsystems, or interconnected devices, in response to the position of user input devices and other control commands. Sealed cooling system 60 as well as other components of refrigerator appliance 10 may be in communication with controller 160 via, for example, one or more signal lines or shared communication busses. In this manner, Input/Output ("I/O") signals may be routed between controller 160 and various operational components of refrigerator appliance 10.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 160 may be constructed without using a microprocessor, e.g., using a combination of discrete analog and/or digital logic circuitry (such as switches, amplifiers, integrators, comparators, flipflops, AND/OR gates, and the like) to perform control functionality instead of relying upon software.

Controller 160 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 160 may be operable to execute programming instructions or micro-control code associated with an operating cycle of refrigerator appliance 10. In this regard, the instructions may be software or any set of instructions that when executed by the processing device, cause the processing device to perform operations, such as running one or more software applications, displaying a user interface, receiving user input, processing user input, etc. Moreover, it should be noted that controller 160 as disclosed herein is capable of and may be operable to perform any methods, method steps, or portions of methods as disclosed herein. For example, in some embodiments, methods disclosed herein may be embodied in programming instructions stored in the memory and executed by controller 160.

Memory devices may also store data that can be retrieved, manipulated, created, or stored by the one or more processors or portions of controller 160. The data can include, for instance, data to facilitate performance of methods described herein. The data can be stored locally (e.g., on controller 160) in one or more databases and/or may be split up so that the data is stored in multiple locations. In addition, or alternatively, the one or more database(s) can be connected to controller 160 through any suitable network(s), such as through a high bandwidth local area network (LAN) or wide area network (WAN). In this regard, for example, controller 160 may further include a communication module or interface that may be used to communicate with one or more other component(s) of refrigerator appliance 10, controller 160, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

Figure 8:
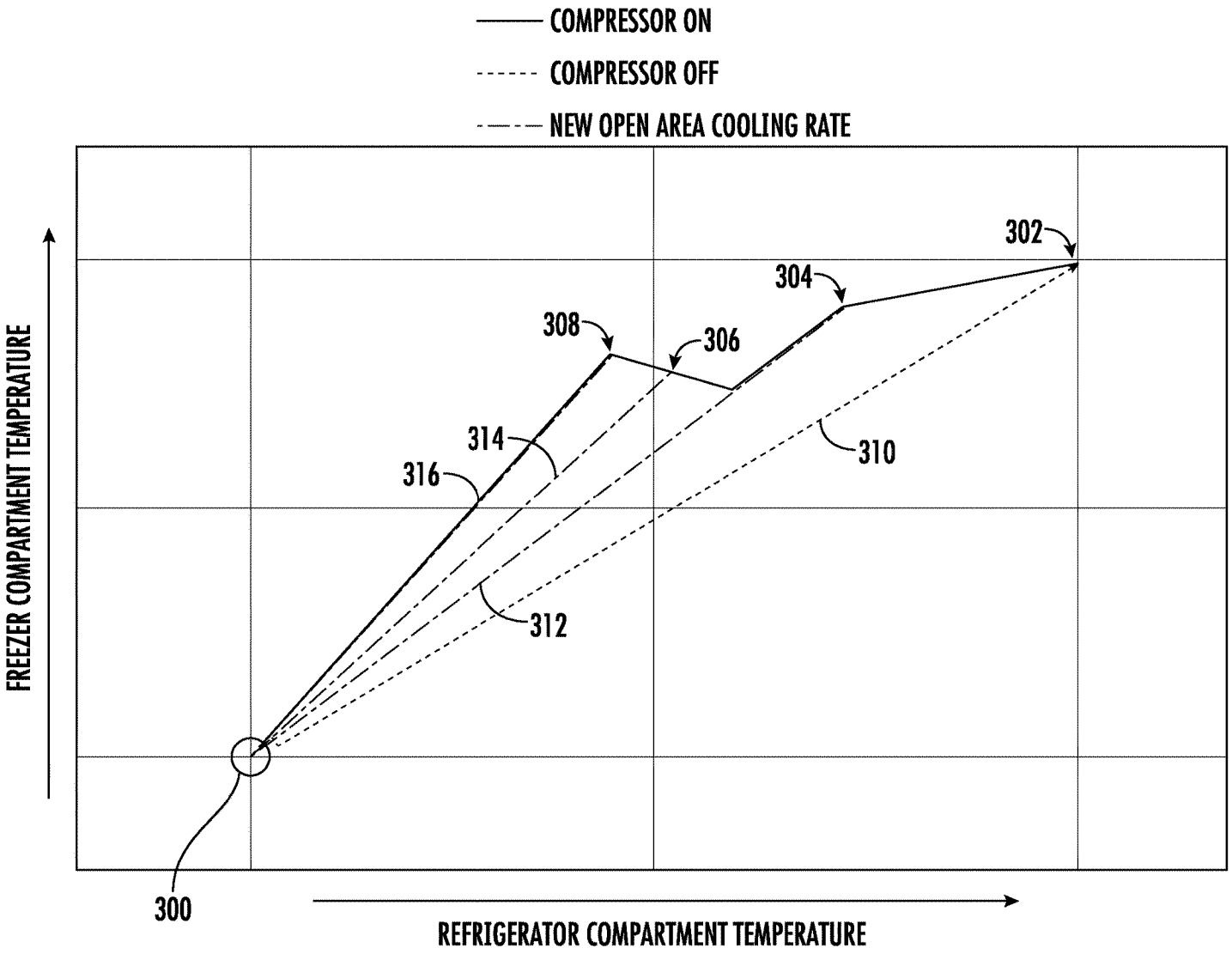
FIG. 8 provides a graphical representation of cooling rates within the refrigerator appliance of FIG. 1 according to example embodiments of the present disclosure.

Referring now to FIG. 8, generally in view of FIGS. 1-7, controller 160 may be in operable communication with freezer damper assembly 200, or more particularly, motor 204 of freezer damper assembly 200. In general, controller 160 may be configured to operate compressor 64 in order to simultaneously cool down both of refrigerating compartment 100 and freezer compartment 149. In particular, freezer damper assembly 200 may encompass freezer fan 74, such that controller 160 may be configured to operate freezer fan 74 in conjunction with compressor 64. Moreover, in order to simultaneously cool down both of refrigerating compartment 100 and freezer compartment 149, controller 160 may be configured to calculate a new open area of freezer damper assembly 200 based on a target temperature state 300. The target temperature state 300 may include both of a refrigerator target temperature of refrigerating compartment 100 and a freezer target temperature of freezer compartment 149. For example, the refrigerator target temperature of refrigerating compartment 100 may be approximately two degrees Celsius (2° C.) and the freezer target temperature of freezer compartment 149 may be approximately negative fifteen degrees Celsius (−15° C.). The specified values of the refrigerator target temperature and the freezer target temperature are provided by way of example only and one of skill in the art would understand that aspects of the present disclosure are not limited to the specified values. Once the new open area of freezer damper assembly 200 is calculated, controller 160 may be configured to adjust a position of freezer damper assembly 200, e.g., the openness of air outlet 218, to provide the calculated new open area.

As shown in FIG. 8, the target temperature state 300 may be represented at a single point (i.e., the target temperature state 300). As shown by line 310, when compressor 64 is OFF, the temperature of both refrigerating compartment 100 and freezer compartment 149 may both increase until the compressor is turned on again. When the compressor turns ON again (e.g., at point 302), refrigerating compartment 100 and freezer compartment 149 may cool down at separate rates of cooling, such as between point 302 and point 304 of FIG. 8, e.g., between point 302 and point 304 the refrigerating compartment 100 is seen cooling faster than freezer compartment 149. However, controller 160 may calculate the new open area of freezer damper assembly 200 based upon a slope and a distance of the line 312 between point 304, representing a current temperature state, and the target temperature state 300. Accordingly, at any point while the compressor is ON, controller 120 may be configured to calculate the slope and the length of a line to reach the target temperature state, whereby refrigerating compartment 100 and freezer compartment 149 may generally reach their respective target temperatures at the same time. For example, provided in FIG. 8 are points 304, 306, and 308, which illustrate various examples of current temperature states. In particular, controller 120 may be configured to calculate various slopes and lengths of lines, such as lines 312, 314, and 316 at the points in time when the current temperature states are at the respective points 304, 306, and 308.

In general, the new open area of freezer damper assembly 200 may be calculated by one of a look-up table or an equation, e.g., the slope and the distance of the line (e.g., one of lines 312, 314, or 316, or other similar line at various points in time when the compressor is ON) between the current temperature state and the target temperature state may be used in conjunction with a look-up table or an equation to calculate the new open area. As such, when freezer damper assembly 200 is adjusted to the calculated new open area, the respective cooling rate of refrigerating compartment 100 and freezer compartment 149 may be configured such that both refrigerating compartment 100 and freezer compartment 149 reach their respective target temperatures at the same time, e.g., refrigerating compartment 100 and freezer compartment 149 are simultaneously and efficiently cooled.

In some example embodiments, in response to reaching one of the refrigerator target temperature or the freezer target temperature first, controller 160 may be further configured to close, e.g., zero percent (0%) open, a respective one of refrigerator damper assembly 224 and the freezer damper assembly 200 in order to cool down the respective compartment that did not reach the respective target temperature. In another scenario, controller 160 may be configured to defrost evaporator 70, whereby, when defrosting evaporator 70, controller 160 may be configured to close, e.g., zero percent (0%) open, freezer damper assembly 200 in order to prevent heat from entering freezer compartment 149.

As one skilled in the art will appreciate, the above described embodiments are used only for the purpose of explanation. Modifications and variations may be applied, other configurations may be used, and the resulting configurations may remain within the scope of the invention. For example, the refrigerator appliance 10 is provided by way of example only and aspects of the present subject matter may be incorporate into any one of a built-in refrigerator appliance, a stand-alone refrigerator appliance, a freezer appliance, or any other suitable multi-compartmental appliances.

Figure 9:
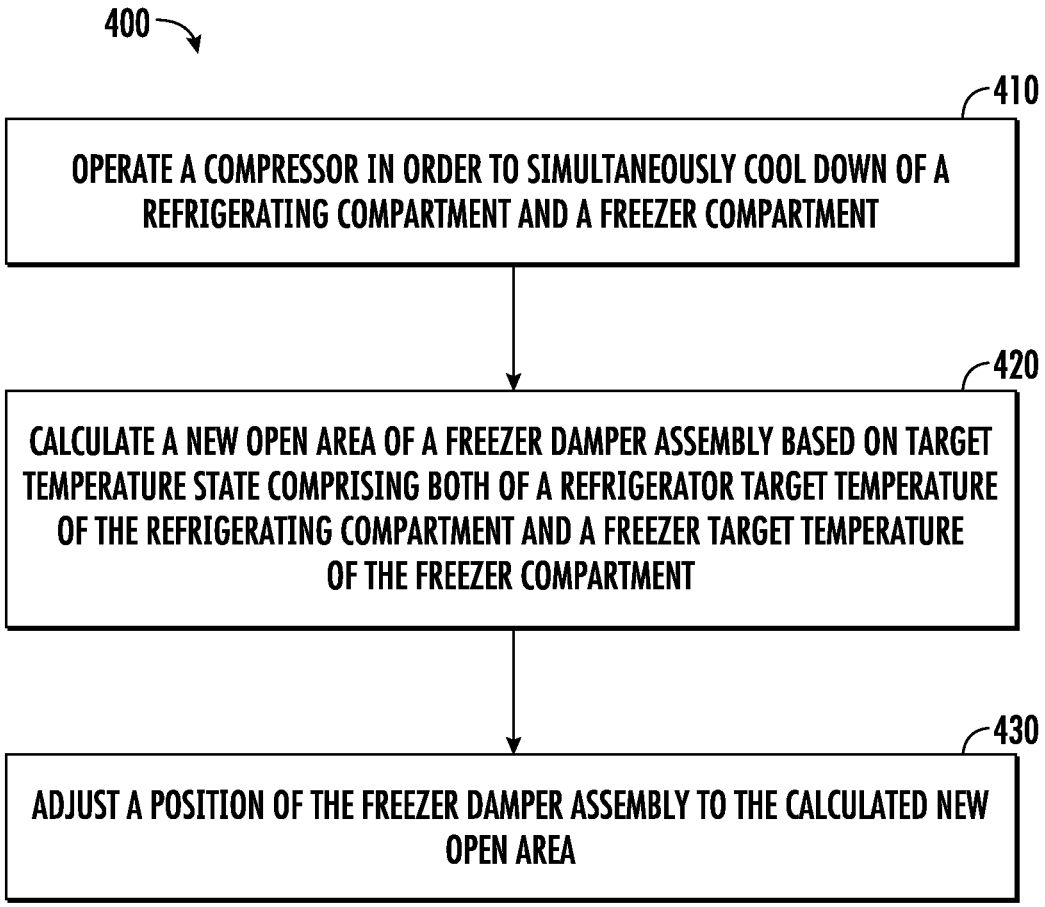
FIG. 9 illustrates a flow diagram of an example method of operating a refrigerator appliance according to aspects of the present disclosure.

Referring now to FIG. 9, a flow diagram of one embodiment of a method 400 of operating a refrigerator appliance 10 is illustrated in accordance with aspects of the present subject matter. In general, method 400 will be described herein with reference to the embodiments of refrigerator appliance 10 and related elements described above with reference to FIGS. 1-8. However, it should be appreciated by those of ordinary skill in the art that the disclosed method 400 may generally be utilized in association with apparatuses and systems having any other suitable configuration. In addition, although FIG. 9 depicts steps performed in a particular order for purposes of illustration and discussion, the method discussed herein is not limited to any particular order or arrangement. One skilled in the art, using the disclosures provided herein, will appreciate that various steps of the method disclosed herein can be omitted, rearranged, combined, and/or adapted in various ways without deviating from the scope of the present disclosure.

As shown in FIG. 9, at (410), method 400 generally includes operating, by controller 160, compressor 64 in order to simultaneously cool down both of refrigerating compartment 100 and freezer compartment 149. As stated above, controller 160 may be generally configured to operate compressor 64 in order to simultaneously cool down both of refrigerating compartment 100 and freezer compartment 149. In particular, freezer damper assembly 200 may encompass freezer fan 74, such that controller 160 may be configured to operate freezer fan 74 in conjunction with compressor 64, whereby cooled air C from the single evaporator 70 may be directed through refrigerator damper assembly 224 into refrigerating compartment 100 and/or through freezer damper assembly 200 into freezer compartment 149. For example, the cooled air C may be selectively directed into one or both of refrigerating compartment 100 and freezer compartment 149, in varying proportions, by adjusting the position of the freezer damper assembly 200, e.g., adjusting the open area of the freezer damper assembly 200 through which the cooled air C may flow into the freezer compartment 149.

At (420), method 400 generally includes calculating, by controller 160, a new open area of freezer damper assembly 200 based on the target temperature state 300. As stated above, the target temperature state 300 may include both of the refrigerator target temperature of the refrigerating compartment 100 and the freezer target temperature of the freezer compartment 149. For example, when calculating the new open area of freezer damper assembly 200, the new open area of freezer damper assembly 200 may be calculated from the slope and the distance of the line between the current temperature state and the target temperature state. Additionally, when calculating the new open area of freezer damper assembly 200, the slope and the distance of the line between the current temperature state and the target temperature state may be used in conjunction with a look-up table or an equation to calculate the new open area.

At (430), method 400 generally includes adjusting, by controller 160, a position of the freezer damper assembly to the calculated new open area. In other words, freezer damper assembly 200 is adjusted to the calculated new open area, the respective cooling rate of refrigerating compartment 100 and freezer compartment 149 may be configured such that both refrigerating compartment 100 and freezer compartment 149 reach their respective target temperatures at the same time, e.g., refrigerating compartment 100 and freezer compartment 149 are simultaneously and efficiently cooled.

As may be seen from the above, a refrigerator appliance with a single evaporator, e.g., there is no other evaporator in the refrigerator appliance, may include an adjustable freezer fan cover. When a compressor of the refrigerator appliance is ON, a controller may calculate the slope and the distance of a line between a target temperature position and the current position, the target temperature position may include both of the refrigerator compartment and the freezer compartment temperatures. Based on the slope and the distance from the current position to the target position, the controller may adjust the open area (or angle) of the damper/freezer fan cover. As such, the refrigerator compartment and the freezer compartment may be cooled simultaneously, thus increasing the cooling efficiency of the refrigerator appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet defining a refrigerating compartment and a freezer compartment;

a sealed cooling system comprising a compressor and an evaporator;

an air circulation duct system in fluid communication with the refrigerating compartment and the freezer compartment, the air circulation duct system comprising a refrigerator duct and a freezer duct;

a refrigerator damper assembly disposed in the refrigerator duct, the refrigerator damper assembly positioned and configured to selectively allow air to pass through the refrigerator duct and into the refrigerating compartment;

a freezer damper assembly disposed in the freezer duct, the freezer damper assembly positioned and configured to selectively allow air to pass through the freezer duct and into the freezer compartment; and a controller disposed in the cabinet, the controller in operable communication with the freezer damper assembly, the controller configured to:

operate the compressor in order to simultaneously cool down both of the refrigerating compartment and the freezer compartment;

calculate a new open area of the freezer damper assembly based on a target temperature state, the target temperature state comprising a refrigerator target temperature of the refrigerating compartment and a freezer target temperature of the freezer compartment; and adjust a position of the freezer damper assembly to provide the calculated new open area.

2. The refrigerator appliance of claim 1, wherein the new open area of the freezer damper assembly is calculated from a slope and a distance between a current temperature state and the target temperature state.

3. The refrigerator appliance of claim 2, wherein the new open area of the freezer damper assembly is calculated by one of a look-up table or an equation.

4. The refrigerator appliance of claim 1, wherein, in response to reaching one of the refrigerator target temperature or the freezer target temperature first, the controller may be further configured to close a respective one of refrigerator damper assembly and the freezer damper assembly in order to cool down the respective compartment that did not reach the target temperature.

5. The refrigerator appliance of claim 1, wherein the controller is further configured to defrost the evaporator.

6. The refrigerator appliance of claim 5, wherein, when defrosting the evaporator, the controller is configured to close the freezer damper assembly in order to prevent heat from entering the freezer compartment.

7. The refrigerator appliance of claim 1, wherein the freezer damper assembly comprises a sliding door configured to translate away from a plurality of slots of the freezer damper assembly, the plurality of slots defining an air outlet, the sliding door defining an opening, wherein, when the sliding door is translated, the opening is configured to align with at least one of the plurality of slots.

8. The refrigerator appliance of claim 1, wherein the freezer damper assembly comprises a plurality of slats configured to translate away from a plurality of slots defining an air outlet.

9. The refrigerator appliance of claim 1, wherein the freezer damper assembly comprises a plurality of slats configured to rotate within an air outlet of the freezer damper assembly.

10. The refrigerator appliance of claim 1, wherein the freezer damper assembly encompasses a freezer fan, the controller configured to operate the freezer fan in conjunction with the compressor.

11. A method of operating a refrigerator appliance, the refrigerator appliance comprising a cabinet defining a refrigerating compartment and a freezer compartment, a sealed cooling system comprising a compressor and an evaporator, an air circulation duct system in fluid communication with the refrigerating compartment and the freezer compartment, the air circulation duct system comprising a refrigerator duct and a freezer duct, a refrigerator damper assembly disposed in the refrigerator duct, the refrigerator damper assembly positioned and configured to selectively allow air to pass through the refrigerator duct and into the refrigerating compartment, a freezer damper assembly disposed in the freezer duct, the freezer damper assembly positioned and configured to selectively allow air to pass through the freezer duct and into the freezer compartment; and a controller disposed in the cabinet, the controller in operable communication with the freezer damper assembly, the method comprising:

operating, by the controller, the compressor in order to simultaneously cool down both of the refrigerating compartment and the freezer compartment;

calculating, by the controller, a new open area of the freezer damper assembly based on a target temperature state, the target temperature state comprising a refrigerator target temperature of the refrigerating compartment and a freezer target temperature of the freezer compartment; and adjusting, by the controller, a position of the freezer damper assembly to provide the calculated new open area.

12. The method of claim 11, wherein, when calculating the new open area of the freezer damper assembly, the new open area of the freezer damper assembly is calculated from a slope and a distance between a current temperature state and the target temperature state.

13. The method of claim 12, wherein, when calculating the new open area of the freezer damper assembly, the new open area of the freezer damper assembly is calculated by one of a look-up table or an equation.

14. The method of claim 11, wherein, when reaching one of the refrigerator target temperature or the freezer target temperature first, the method further comprises closing, by the controller, a respective one of refrigerator damper assembly and the freezer damper assembly in order to cool down the respective compartment that did not reach the target temperature.

15. The method of claim 11, further comprising defrosting, by the controller, the evaporator.

16. The method of claim 15, wherein, when defrosting the evaporator, the method further comprises closing, by the controller, the freezer damper assembly in order to prevent heat from entering the freezer compartment.

17. The method of claim 11, wherein the freezer damper assembly comprises a sliding door, wherein adjusting the position of the freezer damper assembly to the calculated new open area comprises translating, by the controller, the sliding door away from a plurality of slots of the freezer damper assembly, the plurality of slots defining an air outlet, the sliding door defining an opening, wherein, when the sliding door is translated, the opening is configured to align with at least one of the plurality of slots.

18. The method of claim 11, wherein the freezer damper assembly comprises a plurality of slats, wherein adjusting the position of the freezer damper assembly to the calculated new open area comprises translating, by the controller, the plurality of slats away from a plurality of slots of the freezer damper assembly, the plurality of slots defining an air outlet.

19. The method of claim 11, wherein the freezer damper assembly comprises a plurality of slats, wherein adjusting the position of the freezer damper assembly to the calculated new open area comprises rotating, by the controller, the plurality of slats within an air outlet of the freezer damper assembly.

20. The method of claim 11, wherein the freezer damper assembly encompasses a freezer fan, the method further comprising operating, by the controller, the freezer fan in conjunction with the compressor.

* * * * *